United States Patent [19]

Gallaher

[11] Patent Number: 4,601,687

[45] Date of Patent: Jul. 22, 1986

[54] MACHINE FOR MANUFACTURE OF H-DIVIDER CONTAINERS HAVING IMPROVED COMPRESSION RESISTANCE

[75] Inventor: Donald D. Gallaher, Garretson, S. Dak.

[73] Assignee: Weyerhaeuser Company, Tacoma, Wash.

[21] Appl. No.: 689,910

[22] Filed: Jan. 9, 1985

[51] Int. Cl.[4] ..... B31B 11/28; B31B 11/62

[52] U.S. Cl. ..... 493/89; 493/92

[58] Field of Search ..... 493/89, 90, 92, 168

[56] References Cited

U.S. PATENT DOCUMENTS

| | | | |
|---|---|---|---|
| 3,659,505 | 5/1972 | Wasyluka et al. | 493/102 |
| 4,220,076 | 9/1980 | Moen | 493/92 |
| 4,235,159 | 11/1980 | Johnson, Jr. et al. | 493/309 |
| 4,283,188 | 8/1981 | Wingerter et al. | 493/89 |
| 4,398,901 | 8/1983 | Campbell | 493/90 |

OTHER PUBLICATIONS

SWF Design Bulletin No. 162, SWF Machinery, 1/1985.

*Primary Examiner*—Francis S. Husar
*Assistant Examiner*—William E. Terrell

[57] ABSTRACT

The present is a machine for forming an inside-outside Bliss-type H-divider shipping container. It is based on an adaptation of a Moen or similar type single cycle container former. These machines employ a split mandrel which is generally in the form of a rectangular prism approximating the inner dimensions of the container. The H-divider portion of the container is held within the mandrel while the body portion is erected thereabout. Opposed plows mounted on the mandrel are adapted to fold what will become interior flaps joined to the end walls. These plows are located so that at the assembly point of the container they are entirely within the confines of the outer boundaries of the mandrel. Located in this position, they cause no interference with the erection of the body portion of the container.

2 Claims, 8 Drawing Figures

Fig. 6
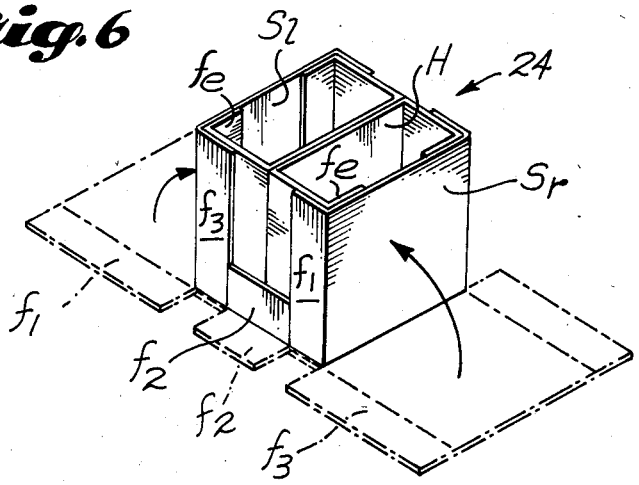
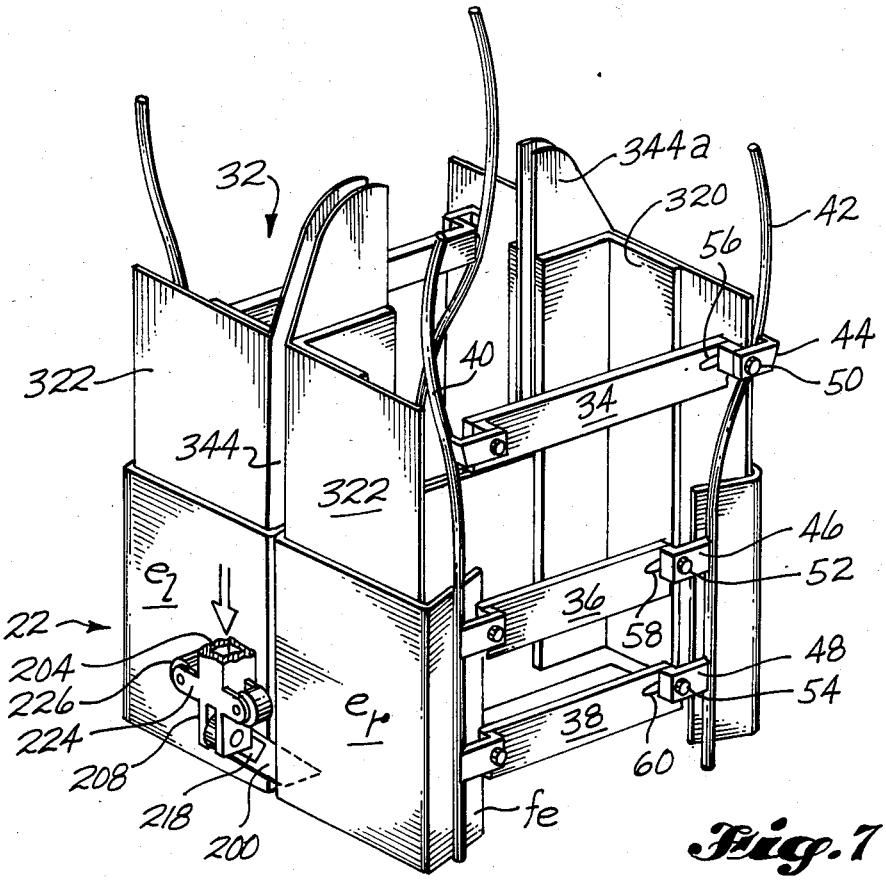
Fig. 7

MACHINE FOR MANUFACTURE OF H-DIVIDER CONTAINERS HAVING IMPROVED COMPRESSION RESISTANCE

BACKGROUND OF THE INVENTION

The present invention relates to a machine for the single cycle manufacture of corrugated H-divider shipping containers. More specifically, the machine is particularly useful for manufacturing containers having an inside-outside Bliss-type corner construction.

H-divider and similar two-cell shipping containers made from corrugated paperboard are well known in the art. Containers of this type can be made in a number of different configurations. A common one is of Bliss-type construction in which the H-divider portion is integral with the end walls, or side walls, of the container. In Bliss-type construction a body blank is folded and assembled about separate end wall portions. Outside flaps integral with the body blank are glued to the end walls to form the container. The Bliss container is a pseudomorph of the slat-type wooden containers still occasionally used for shipping fruit and fresh produce. U.S. Pat. No. 3,679,505 to Wasyluka et al. is one example of a machine designed to produce a conventional Bliss box.

In some of its end wall configurations, Bliss-type containers may have improved top-to-bottom compression resistance, since the end wall flaps can serve as support columns. Top-to-bottom compression or crush resistance is particularly important where palletized containers, which may contain heavy interior contents, are stacked several tiers high in warehouses and during shipping. Improved top-to-bottom compression resistance is normally achieved by putting more fiber in the side and end walls of the container. This can be done by using a heavier basis weight board or by using multiple plies in the side and end walls. In many cases significant improvements in top-to-bottom compression resistance can be achieved by locating the multiple plies only in the corner areas of the container. The inside-outside Bliss container is an example. Here double plies are present in the corner areas along both end and side walls. On the end walls these are located outside of the container and along the side walls they are located inside the container. It should be noted that the terms sides and ends, as well as length and width, are relative in all of the description that follows. The term "end wall" is used to signify that side wall to which the outside body flaps are glued.

Box erecting machines to produce conventional Bliss-type H-divider containers have been available in the marketplace and used succesfully for several years. One of these is described in U.S. Pat. No. 4,220,076, to Moen. In this machine, an H-divider blank is formed into the H-divider and end wall portion at an upper location in the machine. This is then directed downward into a split mandrel. Here the H-divider is held within the mandrel while the end walls are positioned outside of but adjacent to the side walls of the mandrel. The body blank is then raised from below and formed about the mandrel. Both side walls of the container are bent upward against the mandrel faces normal to those supporting the end walls. After the side walls are in place, the end flaps, which are integral with the side walls and bottom, are folded into place and adhesively bonded to the end walls. The finished container is ejected from the mandrel by the next H-blank when it is introduced into the gap between the mandrel halves.

The inside-outside H-divider Bliss container is a very difficult box to form. To the present inventor's knowledge there is only one other machine available which can do this on a single-cycle basis. This has just very recently become available from SWF Machinery, Sanger, Calif. For this reason, containers of this type have had little availability in the marketplace despite their obvious attribute of superior top-to-bottom compression resistance.

The present invention enables an inside-outside Bliss-type container to be produced in a single-cycle operation on a Moen or similar type former.

A number of previous attempts have been made to modify a Moen or similar type machine to form an inside-outside Bliss-type construction. However, these have all been unsuccessful prior to the time of the present invention.

SUMMARY OF THE INVENTION

The present invention is a single-cycle machine for forming an inside-outside Bliss-type H-divider shipping container. As briefly described before, this container is made from an H-divider blank and a body blank. An H-divider blank is first erected into the H-divider having integral pairs of end walls about which the body blank is then erected. Each body blank has a rectangular bottom panel which is joined along each side by parallel score lines to foldable rectangular side panels. The bottom panel and each side panel have individual foldable flaps at each end. When the containers are erected these are adhesively engaged with the exterior peripheral surfaces of the end walls. The end walls each have foldable flaps which are adapted to lay along the interior surface of the side panels at each corner location. These flaps are oriented normal to the end walls in the assembled container.

The present invention comprises an improvement in a Moen or similar type machine using a split mandrel about which the body blank is erected. The split mandrel has opposing, spaced apart inner surfaces laying in parallel planes and defining a gap between the mandrel halves. The volume defined between these planes is unobstructed in order to allow passage therethrough of the H-divider portion of the container. The lower portion of the mandrel generally defines a rectangular prism which approximates the inner dimensions of the container.

In the present invention, the split mandrel has generally open outer side faces oriented in planes parallel to the opposed inner mandrel surfaces. It has generally solid surfaces on the outer side faces laying in planes normal to the planes of the inner surfaces. A critical part of the invention is the provision of plows adapted to form the end wall flaps. These plows are located adjacent to and generally within each edge of the generally open outer faces of the mandrel. In the most preferred form of the invention the plows will be physically mounted on the mandrel halves. The plows have two functional portions. The first is an entry portion which extends outside the prism planes defining the generally open outer side faces of the mandrel. These engage and begin folding the descending H-divider end wall flaps. The second section of the plow is a holding portion which is contained downstream from the entry portion. This is contained entirely within the side face planes and located so as to complete the fold and hold the folded end wall flaps in a noninterfering position while the body blank is folded and joined to the end walls of the H-divider.

The provision of and location of the plows is critical to the success of the invention.

It is an object of the present invention to provide a single cycle container forming machine which can erect an inside-outside Bliss-type container.

It is further object of the invention to provide a machine having plows mounted on the sides of the mandrel of a Moen or similar type forming machine.

It is another object of the invention to provide a simple modification for a Moen or similar type machine which enables erection or an inside-outside Bliss-type container without any reduction in production rate.

These and many other objects will become readily apparent to those skilled in the art upon reading the following detailed description, taken in conjunction with the drawings.

BRIEF DESCRIPTION OF THE DRAWINGS

FIGS. 1–6 show the various steps in assembly of an inside-outside Bliss-type container from the H-divider blank and body blank.

FIG. 7 shows the body defining mandrel modified with folding plows for forming the end wall flaps. A formed H-divider is shown in place ready to receive the body blank.

DESCRIPTION OF THE PREFERRED EMBODIMENTS

It is helpful to the complete understanding of the present invention for one to be familiar with the operation of a Moen-type machine such as is described in U.S. Pat. No. 4,220,076, which patent is hereby incorporated by reference. The Moen machine is relatively complex. However, it is not necessary to describe it in full detail here for an adequate understanding of the present invention. A large part of the complexity of the Moen machine is due to its adaptability for formation of containers of various sizes and configurations. The present invention is fully compatible with this flexibility.

Figures 1, 2, 3, 4, 5:
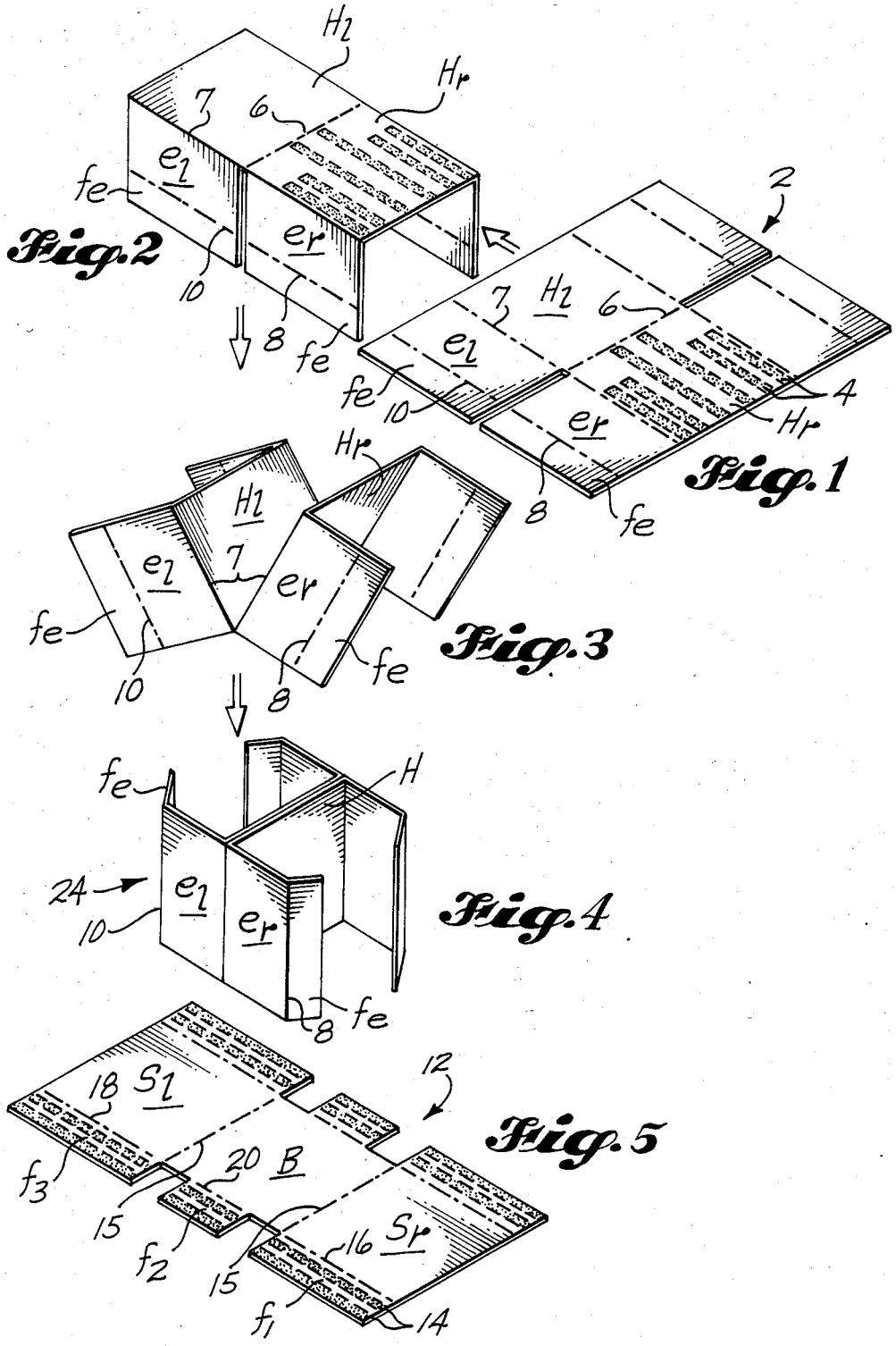

Referring to the drawings, FIG. 1 shows a slit and scored H-divider blank, generally indicated at 2. This is composed of a right side H-divider panel $H_r$ and a corresponding leftside panel $H_l$. These are attached through a crushed score line 7 to a right side end wall $e_r$ and corresponding left side end wall $e_l$. The two halves of the H-divider portion are separated by a score line 6 which may either be a crushed score or may be a cut through the upper liner and corrugated medium, with the lower liner being left intact. As the H-blank is fed into the H-divider forming section, adhesive strips 4 are applied to one or both of what will become the interior surfaces of the H-divider panels. As a first forming step the end wall portions $e_r$ and $e_l$ are bent downwards along scoreline 7, as shown in FIG. 2. Then, as seen in FIG. 3, the H-divider section is formed by folding along score line 6 so that panels $H_r$ and $H_l$ are adhesively bonded and become unitized into panel H. Next, the end wall flaps $f_e$ are folded along score lines 8. An intermediate stage of this folding process is seen in FIG. 4. In actuality, flaps $f_e$ are folded more than 90° by the plows. When the container is ejected from the mandrel these flaps retain sufficient memory that they will spring back and remain tightly in place along the side walls.

A container body blank is shown in FIG. 5. This consists of a bottom panel B and a right side panel $S_r$ and a left side panel $S_l$. The side panels are united to the bottom panel along fold lines 15. The body blank also has appropriate end flaps mounted along each edge. Flap $f_1$ is connected to side panel $S_r$ along score line 16. The bottom end flap $f_2$ is connected to the bottom panel B along score line 20. Finally, flap $f_3$ is connected by score line 18 to left side panel $S_l$. Adhesive 14 is supplied in any appropriate pattern to the body panel flaps so that they will bond to the end panels of the H-divider portion when the container is assembled.

An assembled container 24 is shown in FIG. 6. For the sake of simplicity in illustration and understanding this is shown as having an open top. It will be understood by those skilled in the art that the container could have significantly different configurations than the one shown here without departing from the spirit of the invention.

Figure 8:
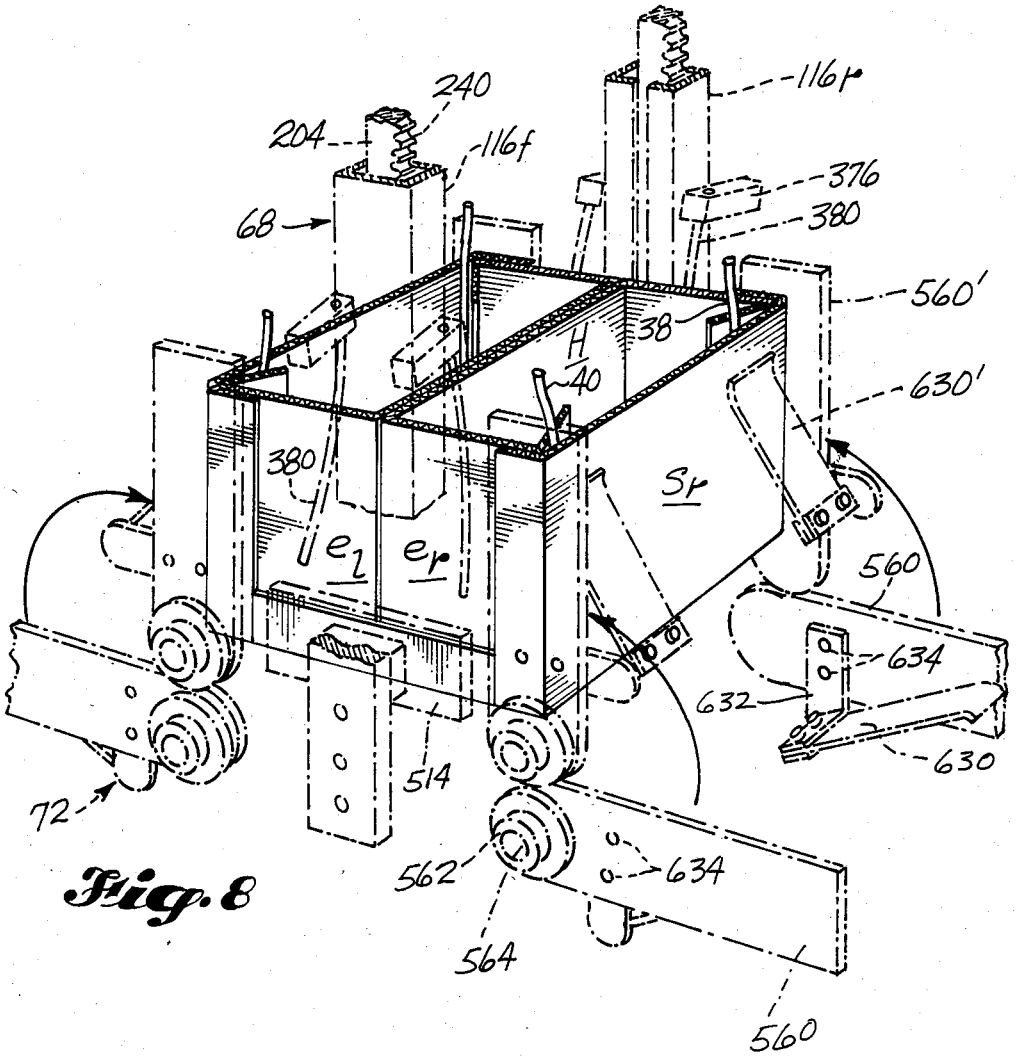
FIG. 8 shows a body blank folding means which erects the body of the container around the H-divider held in the mandrel.

The improvements which comprise the present invention are best seen in FIG. 7. It might be noted that elements numbered 68 and higher have been given number designations which correspond to the same element as disclosed in the aforementioned Moen patent. The split mandrel of the forming machine is shown generally at 32. Since this is bilaterally symmetrical both front to back and side to side, for the sake of simplicity not all of the individual elements shown in the drawing have been numbered. The mandrel is generally built using corner braces of angle iron 320 to which solid side plates 322 are appropriately attached by flush headed machine screws or other suitable means, not shown. Each of these corner braces has an attached shoe 344 which faces into the gap between the mandrel halves. These shoes have a lead-in portion **344*a* where the prefolded H-divider 22 enters the mandrel assembly. The H-divider portion 22 is carried into the mandrel by a reciprocating down-feed means generally indicated at 68. Only the lower portion of this is seen on FIG. 7 where it comprises a square rod 204 terminated by thin fold and transport fingers 200. These are normally made of spring steel and will be only about 1.5 mm in thickness. The fingers are held within a slot in the lower end of rod 204 formed by lugs 208 where they are held in a centered position by appropriate shims 218. The lower end of rod 204 also bears brackets 224 which hold guide rollers 226. As seen in FIG. 8, the guide rollers operate on the inside surfaces of a rectangular guide tube 116. The upper end of reciprocating rods 204 is machined to contain rack gear teeth 240** which serve through appropriate pinions, not shown, to reciprocate the mechanism that positions the H-blank between the mandrel halves.

A critical part of the present invention are the end flap forming plows, best seen in FIG. 7. Support brackets 34, 36, and 38 are mounted between side plates 322 by fasteners 39. Plows 40 and 42 are attached to adjustable support brackets 44, 46, and 48. These are held by bolts or other suitable fasteners 50, 52, 54, to the main support brackets 34, 36, and 38, respectively. Slots 56, 58, and 60, machined into the main support brackets enable precise adjustment of the plows.

Plows 40 and 42 have an entry portion which begins to fold the end wall flaps of the descending H-blank. This entry portion extends outside of the planes defining the rectangular prismatic form of the mandrel. Stated differently, the upper ends of plows 40, 42 lay outside of a plane laying across side plate edges 62, 64. At approximately the location of uper support bracket 34, the plows enter the plane defining the open face portion of the mandrel. Below this point both the plows and their supporting hardware lay fully inside the palne defined by edges 62 and 64; i.e., within the outline of the mandrel. This is essential to allow the body blank sides to be folded into the proper position where they will tightly engage the edges of flaps $f_e$.

Final assembly of the container is shown in FIG. 8. The body blank forming and folding means, generally shown at 72, raises an indexed body blank from below until it contacts the bottom portion of the mandrel. At that time the die plates 560 are caused to rotate in toward the mandrel. Those shown on the right side of the drawing rotate counterclockwise, while those shown on the left side rotate clockwise. This raises the side panels $S_r$ and $S_l$ into the final position for assembly. Here they are held by spring steel shoes 630. These fold shoes are attached to die plates 560 through brackets 632 and appropriate fasteners 634. As die plates 560 complete their rotaion, body blank end flaps $f_1$ and $f_3$ are brought into position where they are held against and bonded to end panels $e_r$ and $e_l$ of the container. The end flap $f_2$ attached to bottom panel B is brought into position by horizontal die plates 514. During assembly, end panels $e_r$ and $e_l$ are held in proper position against mandrel side plates 322 by spring steel rods 380. These are actuated by a bell crank mechanism, partially shown at 376, mounted on the guide tubes 116. Guide tube 116$_f$ is located outside the front end panel of the container, while guide 116$_r$ is located outside the rear panel. Note that the end panel flaps $f_e$, which are now positioned inside the container, are held behind plows 40 and 42 where they ar not directly in contact with the side panels of the container except along fold lines 8. After an adequate period of time for the adhesive to set, die plates 560 retract to their original position and the body blank folding and forming means is dropped to a position which will enable the now fully erected container to be ejected from the split mandrel through the action of the next descending H-blank.

It will be apparent to those skilled in the art that many variations are possible in the mechanism which has just been described without departing from the spirit of the invention. As one example, the Moen machine uses a vertically oriented split mandrel. Other related machines on the market use a horizontally oriented split mandrel. The present invention would work equally as well on a machine of the horizontal type. It is also within the scope of the invention to make the plow assembly adjustable to be fully compatible with an adjustable length Moen mandrel. It is equally within the scope to make and use readily replacable mandrels, each of which is adapted to make a single sized container. It is thus the intention of the inventor that the invention should be limited only as described in the attached claims and their mechanically equivalent structures.

What is claimed is:

1. In a machine for forming an inside-outside Bliss-type H-divider shipping container, said container being made from an H-divider blank and a body blank and having a formed interior H-divider connecting opposite pairs of end walls about which a flat body blank is erected, the body blank having a rectangular bottom panel joined along each side by parallel score lines to foldable rectangular side panels, the bottom panel and each side panel having individual foldable flaps at each end for adhesive engagement with the exterior peripheral surfaces of the end walls, and the end walls each having foldable flaps adapted to lie along the interior surface of the side panels at each corner, said flaps being oriented normal to the end walls in the assembled container, the improvement which enables folding and assembly of the interior end wall flaps which comprises:

(a) split mandrel means for receiving said H-divider blank, said mandrel means having opposing spaced apart inner surfaces lying in parallel planes, the volume defined between said planes being unobstructed to allow passage therethrough of the H-divider portion of the container, the lower portion of the mandrel means generally defining a rectangular prism approximating the inner dimensions of the container, the mandrel means having generally open outer side faces lying in planes parallel to the opposing inner surfaces and generally solid surfaces on the outer side faces lying planes normal to the planes of the inner surfaces;

(b) opposed plow means for folding said endwall flaps, said plow means being located adjacent to the generally open outer faces of the mandrel means and having H-divider entry portions extending outside the prism planes defining the generally open outer side faces of the mandrel means, in order to engage and begin folding the H-divider endwall flaps, and having holding portions contained entirely within said side face planes so as to hold said flaps after folding in noninterfering positions while the body blank is folded and joined to the end walls of the H-divider;

(c) H-fold blank forming means mounted above the mandrel means for forming the H-divider blank into an H-divider;

(d) reciprocating downfeed means operatively associated with the mandrel means to insert the folded H-divider between the spaced apart inner surfaces of the mandrel means and cause the endwall flaps to be folded by the plow means; and (e) body blank folding means mounted beneath the split mandrel means for lifting and folding a body blank upwardly around the opposite generally open sides of the mandrel means and for folding the adhesive coated bottom and side panel flaps into uniting contact with the end panels.

2. The machine of claim 1 in which the plow means are mounted on the mandrel means.

* * * * *